US011373835B2

(12) United States Patent
Deuringer et al.

(10) Patent No.: US 11,373,835 B2
(45) Date of Patent: Jun. 28, 2022

(54) ELECTRON-EMISSION DEVICE

(71) Applicant: Siemens Healthcare GmbH, Erlangen (DE)

(72) Inventors: Josef Deuringer, Herzogenaurach (DE); Joerg Freudenberger, Kalchreuth (DE)

(73) Assignee: SIEMENS HEALTHCARE GMBH, Erlangen (DE)

( * ) Notice: Subject to any disclaimer, the term of this patent is extended or adjusted under 35 U.S.C. 154(b) by 0 days.

(21) Appl. No.: 16/971,018

(22) PCT Filed: Jan. 25, 2019

(86) PCT No.: PCT/EP2019/051860
§ 371 (c)(1),
(2) Date: Aug. 19, 2020

(87) PCT Pub. No.: WO2019/166161
PCT Pub. Date: Sep. 6, 2019

(65) Prior Publication Data

US 2021/0082653 A1 Mar. 18, 2021

(30) Foreign Application Priority Data

Feb. 27, 2018 (EP) ..... 18158898

(51) Int. Cl.
*H01J 35/04* (2006.01)
*H01J 35/06* (2006.01)
*H01J 35/14* (2006.01)

(52) U.S. Cl.
CPC ..... *H01J 35/045* (2013.01); *H01J 35/064* (2019.05); *H01J 35/065* (2013.01); *H01J 35/14* (2013.01); *H01J 2235/062* (2013.01)

(58) Field of Classification Search
CPC ..... H01J 35/045; H01J 35/065; H01J 35/066
See application file for complete search history.

(56) References Cited

U.S. PATENT DOCUMENTS 5,259,014 A * 11/1993 Brettschneider ..... H01J 35/066 378/138
5,857,883 A 1/1999 Tada et al.
(Continued)

FOREIGN PATENT DOCUMENTS

DE 4100297 A1 7/1992
DE 19727606 A1 1/1999
(Continued)

OTHER PUBLICATIONS

Bogdan Neculaes et al., "Multisource inverse-geometry CT. Part II. X-ray source design and prototype", Medical Physics 43 (8), American Association Physical Medicine, pp. 4617-4627.
(Continued)

*Primary Examiner* — Chih-Cheng Kao
(74) *Attorney, Agent, or Firm* — Harness, Dickey & Pierce, P.L.C.

(57) ABSTRACT

An X-ray tube of an embodiment includes an anode; and an electron emission device. In an embodiment, the electron emission device includes at least one electron emitter including at least one emission surface and at least one barrier grid, the at least one barrier grid being spaced apart from the at least one emission surface of the electron emitter and includes a definable number of individually controllable grid segments. According to an embodiment, at least one individually definable grid voltage is applicable to each of the grid segments. In a simple manner, an electron-emission device of an embodiment permits the image quality to be adjusted with minimal anode loading.

4 Claims, 4 Drawing Sheets

(56) References Cited

U.S. PATENT DOCUMENTS

| | | | | |
|---|---|---|---|---|
| 6,084,340 | A | 7/2000 | Bachmann et al. | |
| 7,751,528 | B2 | 7/2010 | Zhou et al. | |
| 7,817,777 | B2 | 10/2010 | Baumann et al. | |
| 7,835,501 | B2 | 11/2010 | Hauttmann et al. | |
| 8,054,944 | B2 | 11/2011 | Freudenberger et al. | |
| 8,374,315 | B2 | 2/2013 | Freudenberger | |
| 2001/0014139 | A1* | 8/2001 | Price | H01J 35/105 378/130 |
| 2004/0240616 | A1* | 12/2004 | Qiu | H01J 35/065 378/136 |
| 2008/0069420 | A1* | 3/2008 | Zhang | H01J 35/065 382/132 |
| 2009/0022264 | A1* | 1/2009 | Zhou | A61B 6/025 378/5 |
| 2012/0082300 | A1* | 4/2012 | Onken | H01J 35/045 378/136 |
| 2018/0277331 | A1* | 9/2018 | Schultheis | H01J 35/045 |

FOREIGN PATENT DOCUMENTS

| | | | |
|---|---|---|---|
| DE | 102010043540 | A1 | 3/2012 |
| DE | 102012209089 | A1 | 12/2013 |
| IN | 201400992 | I2 | 4/2016 |

OTHER PUBLICATIONS

International Search Report PCT/ISA/210 for International Application No. PCT/EP2019/051860 dated May 14, 2019.

Written Opinion of the Searching Authority PCT/ISA/237 for International Application No. PCT/EP2019/051860 dated May 14, 2019.

European Search Report for European Application No. 18158898.9 dated Jul. 17, 2018.

* cited by examiner

ELECTRON-EMISSION DEVICE

PRIORITY STATEMENT

This application is the national phase under 35 U.S.C. § 371 of PCT International Application No. PCT/EP2019/051860 which has an International filing date of Jan. 25, 2019, which designated the United States of America and which claims priority to European Application No. EP18158898.9 filed Feb. 27, 2018, the entire contents of each of which are hereby incorporated by reference herein, in their entirety and for all purposes.

FIELD

Embodiments of the present invention generally relate to an electron-emission device.

BACKGROUND

An electron-emission device is known from DE 41 00 297 A1 which comprises an electron emitter with an emission surface and a barrier grid. The barrier grid is spaced apart from the emission surface of the electron emitter and has a predefinable number of individually controllable grid segments. For this purpose all grid segments are assigned a switch and a series resistor. Thanks to the switches, each of the grid segments can be switched on or off.

U.S. Pat. No. 5,857,883 furthermore discloses an electron-emission device with an electron emitter and an emission surface facing the barrier grid. The barrier grid is spaced apart from the emission surface of the electron emitter and has multiple grid segments that can be switched on individually.

An electron-emission device which is embodied as a thermionic emission device is described for example in U.S. Pat. No. 8,374,315 B2. In the known case the electron-emission device comprises at least one flat emitter having at least one emission surface which thermally emits electrons when a filament voltage is applied. Furthermore, the known electron-emission device comprises at least one barrier grid which is spaced apart from the emission surface of the flat emitter. In the known case the barrier grid acts as a control electrode, since because of the application of a grid voltage the emission of electrons from the material of the emission surface can be varied. As a result, defined partial beams of the electron emission can be generated.

U.S. Pat. No. 7,835,501 B2 and DE 10 2012 209 089 A1 describe the possibility of a power increase thanks to the use of asymmetric focal point shapes.

Furthermore, it is known from U.S. Pat. No. 8,054,944 B2 for multiple electron beams which can be deflected by deflection devices to be directed onto an anode.

Additionally, so-called "coded spot" methods are disclosed in U.S. Pat. No. 7,817,777 B2 and in IN 201400992 I2.

Field effect emission cathodes are described for example in U.S. Pat. No. 7,751,528 B2 (in particular FIG. 11*b* and FIG. 8) and in the publication "Multisource inverse-geometry CT. Part II. X-ray source design and prototype" (Authors: V. Bogdan Neculaes et al.) in Medical Physics 43 (8), August 2016, pages 4617-4627, in particular FIG. 7). A metal grid lies across a wide-area emission surface of an emitter material (carbon nanotubes or dispenser cathode material, such as e.g. barium oxide). Dispenser cathodes are also called discharge cathodes. By applying a voltage to the complete grid the emission current strength of the complete surface is controlled. The current flowing onto the barrier grid heats up the barrier grid and limits the current strength and pulse time of the electron emission, thereby preventing damage to the barrier grid.

U.S. Pat. No. 7,751,528 B2 furthermore describes connecting multiple cathodes individually in order to switch electron beams on and off at some distance from one another.

SUMMARY

At least one embodiment of the present invention is directed to an electron-emission device for an X-ray tube, which in a simple manner permits the image quality to be adjusted with minimal anode loading.

Advantageous embodiments of the invention are in each case the subject matter of the claims.

In an embodiment, an X-ray tube includes an anode; and an electron emission device. In an embodiment, the electron emission device includes at least one electron emitter including at least one emission surface and at least one barrier grid which is spaced apart from the emission surface of the electron emitter and has a predefinable number of individually controllable grid segments. According to an embodiment of the invention, at least one individually predefinable grid voltage can be applied to each of the grid segments in each case. The predefinable grid voltage here lies between a lower limit value, which does not necessarily have to be zero, and an upper limit value, which can also lie below a permissible maximum value.

The X-ray tube according to an advantageous embodiment are suitable for installation in a focus head.

It is possible in a simple manner to manufacture an X-ray tube which enables the image quality to be adjusted with a small anode loading.

The X-ray tubes described above in at least one embodiment can be installed in the emitter housing of an X-ray emitter without modifications.

BRIEF DESCRIPTION OF THE DRAWINGS

Example embodiments of the invention which are shown schematically are explained in more detail below with the aid of the drawing, without however being restricted thereto, in which drawings.

DETAILED DESCRIPTION OF EXAMPLE EMBODIMENTS

Figure 1:
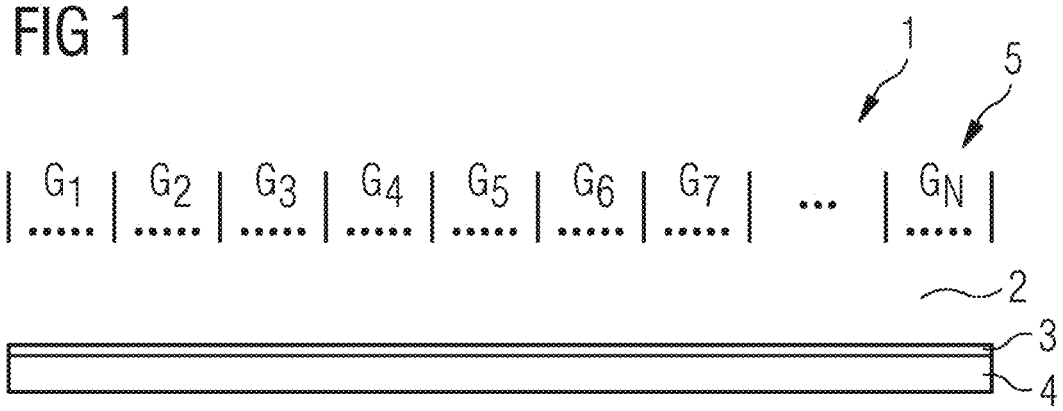
FIG. 1 shows a schematic representation of the electron-emission device according to an embodiment of the invention.

An electron-emission device for an X-ray tube in an embodiment, in a simple manner permits the image quality to be adjusted with minimal anode loading.

In an embodiment, the electron-emission device comprises at least one electron emitter having at least one emission surface and at least one barrier grid which is spaced apart from the emission surface of the electron emitter and has a predefinable number of individually controllable grid segments. According to an embodiment of the invention, at least one individually predefinable grid voltage can be applied to each of the grid segments in each case. The predefinable grid voltage here lies between a lower limit value, which does not necessarily have to be zero, and an upper limit value, which can also lie below a permissible maximum value.

Because in the solution according to at least one embodiment of the invention, at least one individually predefinable grid voltage can be applied to each of the grid segments in each case, partial beams of the electron beam (electron partial beams) can be selectively generated for a predefinable number of individually controllable grid segments. The barrier grid thus forms a reliable control electrode in the case of the X-ray tube at least one embodiment.

The segmented barrier grid is spaced apart from the emission surface of the electron emitter. Because of the individually controllable grid segments, different voltage patterns can be generated, thanks to which a plurality of different electron beams can be generated. In connection with the invention it is for example possible to enable an electron emission alternately in each case by an individual grid segment. It is however likewise possible for multiple grid segments, which need not necessarily be arranged adjacently, to enable an emission of electrons from the emission surface of the electron emitter simultaneously. Thus thanks to the selective blocking of individual grid segments the electron emissions and therefore the spatial distributions of the emitted electrons which determine the focal point shapes can be selectively varied. Thus an optimum adjustment to the respective individual application is reliably possible.

The individual grid segments are variously permeable by the respectively applied grid voltages for the emitted electrons. In the case of a grid segment to which a smaller grid voltage is applied a correspondingly higher emission of electrons occurs. Conversely, in the case of a correspondingly higher grid voltage a correspondingly smaller emission of electrons occurs.

The barrier grid and the grid segments always have a positive potential compared to the emission surface of the electron emitter. The grid segments in the non-emitting regions lie either on the potential of the emission surface of the electron emitter or on a potential that is more negative than the potential of the electron emitter. If the potentials are selected accordingly, the electron beam can be deflected or focused in the emission region. The choice of the distribution of the emitted electrons is thus virtually unrestricted.

In the case of X-ray tubes for diagnostic imaging, properties are required, thanks to which the focal point on the anode which forms the X-ray source surface ("Point Spread Function", PSF, or the emission distribution) can be dynamically changed. With a function such as this a series of improvements can be achieved:

Increase in the electrical power density in the focal point (thanks to asymmetric emission distribution), Increase in the continuous power in the case of connected carbon nanotube emitters (thanks to the use of multiple electron beams), Improvement in the resolution capability (thanks to coded spot algorithms).

According to a preferred example embodiment of the electron-emission device, the electron emitter is embodied as a dispenser cathode (also called a Spindt cathode), which emits electrons when an electric field strength is applied. The term "dispenser cathode" refers to a cathode in which the carrier material is coated with a dispenser cathode material which emits electrons when an electric field strength is applied. Examples of suitable dispenser cathode materials are barium oxide (BaO) and lanthanum hexaboride (LaB6).

In a likewise advantageous embodiment of the electron-emission device, the electron emitter is embodied as a field effect emitter, which likewise emits electrons when an electric field strength is applied. In connection with at least one embodiment of the invention, the field effect emitters can for example be embodied as CNT-based field emitters (CNT, carbon nanotubes) or as Si-based field emitters (Si, silicon). Nanocrystalline diamond is also suitable for the manufacture of cold cathodes according to DE 197 27 606 A1, the entire contents of which are hereby incorporated herein by reference.

According to a further advantageous alternative embodiment of the electron-emission device, the electron emitter is embodied as a thermal emitter (thermionic emission) which emits electrons when a filament voltage is applied. The emission surface of the electron emitter is preferably structured. This structuring can be achieved in the case of a flat emitter with a rectangular surface by slits on the emission surface for example.

For specific requirements, in at least one embodiment, it may be advantageous for a second barrier grid to be arranged spaced apart from the barrier grid, wherein the planes of both barrier grids run parallel to one another, and wherein the second barrier grid likewise has a predefinable number of individually controllable grid segments and the grid segments of the barrier grid run orthogonally to the grid segments of the second barrier grid. Thus the emission distribution of the electrons can be arbitrarily controlled in two spatial directions.

The electron-emission device according to embodiments of the invention or other advantageous embodiments are suitable for installation in a focus head.

With the electron-emission device or with a focus head fitted therewith, it is possible in a simple manner to manufacture an X-ray tube in at least one embodiment, which enables the image quality to be adjusted with a small anode loading.

The X-ray tubes described in at least one embodiment above, can be installed in the emitter housing of an X-ray emitter without modifications.

The electron-emission device shown in FIG. 1 in the schematic representation comprises an electron emitter 2 having an emission surface 3 and having a barrier grid 5 which is spaced apart from the emission surface 3 of the electron emitter 2. The barrier grid 5 has individually controllable grid segments $G_1$ to $G_N$. Purely for reasons of clarity, only seven grid segments have been shown for the illustration, in other words for the number N of grid segments N=7. The invention is further not restricted to a single electron emitter 2, nor to a single emission surface 3. Depending on the individual application, multiple electron emitters 2 can be provided, as well as multiple emission surfaces 3 for each electron emitter 2. The same applies for the barrier grid 5. Here too, multiple barrier grids 5 can be provided. Purely for reasons of clarity, this restriction has been chosen in the schematic representation.

Figure 6:
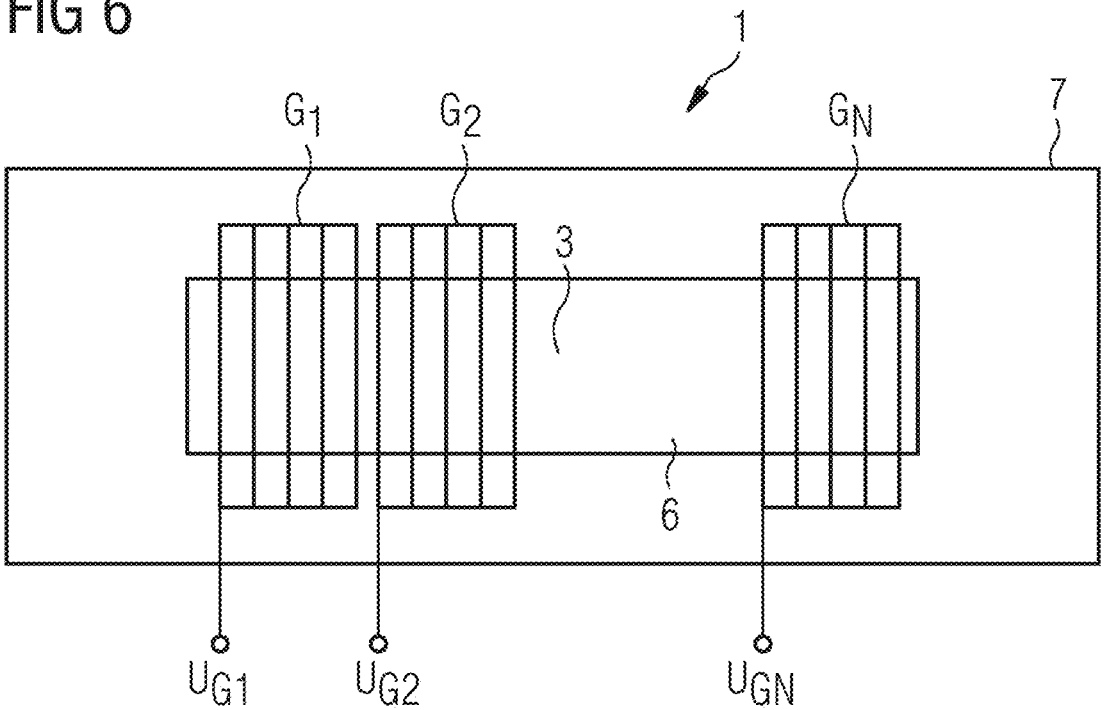
FIG. 6 shows a top view of the electron-emission device according to FIG. 5.

A freely selectable grid voltage UG1 to UGN can be applied to each of the grid segments $G_1$ to $G_N$ (see FIG. 6). A different grid voltage $U_{GN}$ can therefore also be applied to each of the grid segments $G_1$ to $G_N$. Thus different electric fields are then in place in each case in the regions between the respective grid segments $G_1$ to $G_N$ and the emission surface 3, resulting in different emissions of electrons from the emission surface 3 of the electron emitter 1.

Figure 2:
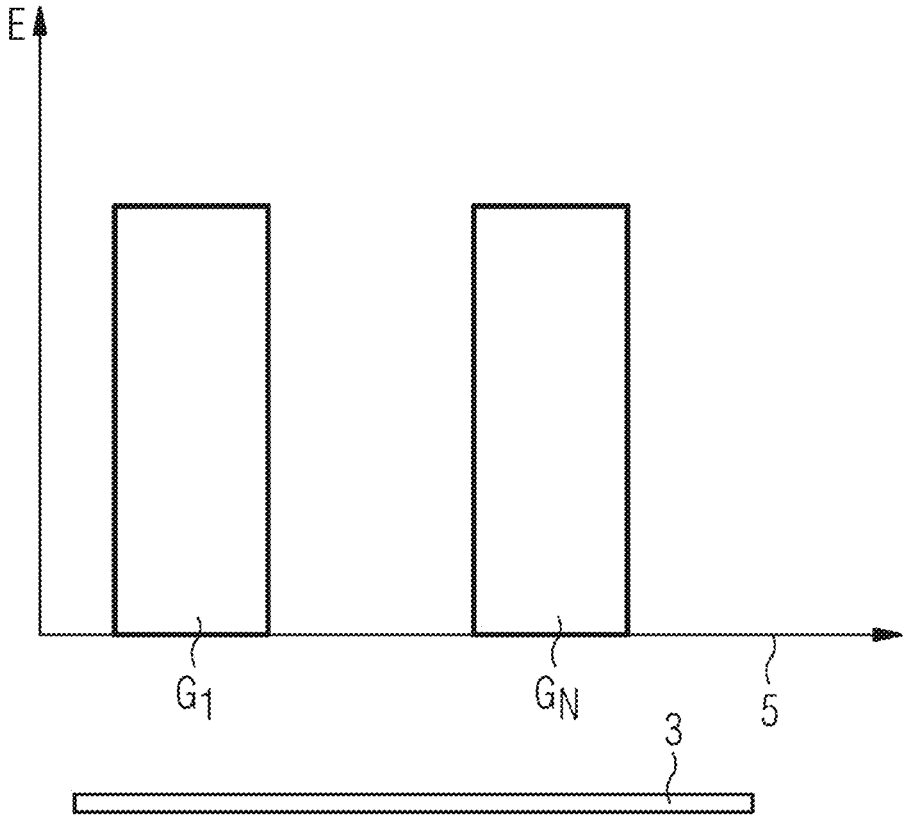
FIG. 2 shows a first example of an emission distribution of the electrons exiting from the electron-emission device according to FIG. 1.
Figure 3:
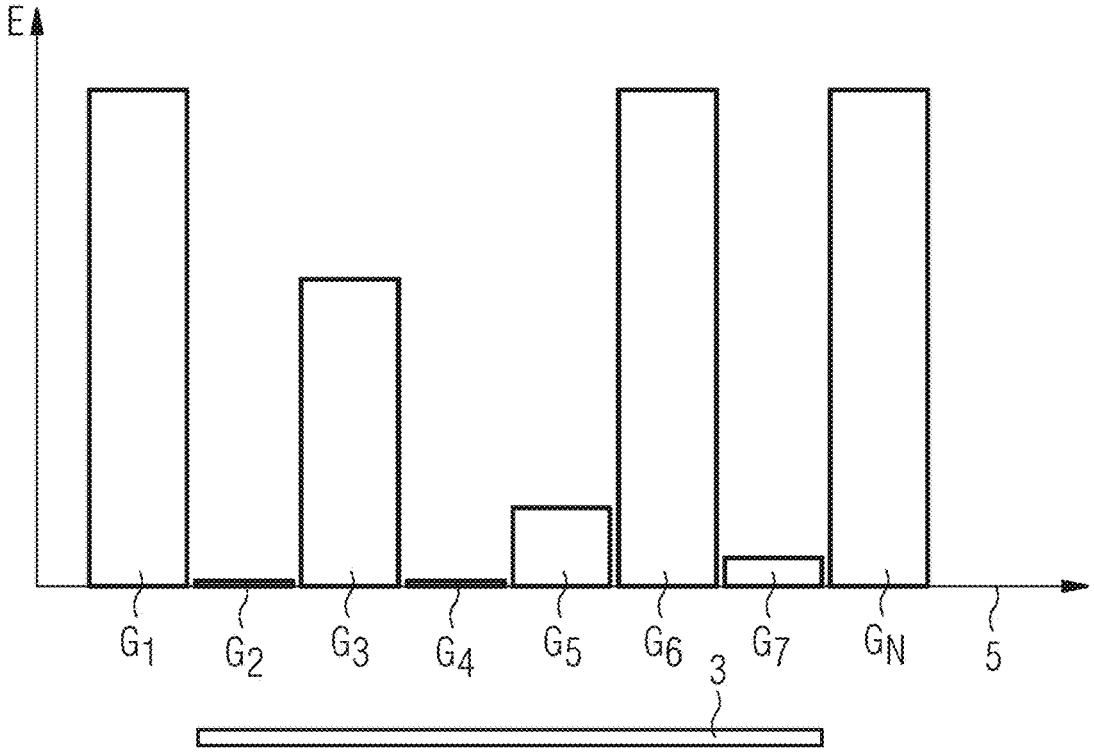
FIG. 3 shows a second example of an emission distribution of the electrons exiting from the electron-emission device according to FIG. 1.
Figure 4:
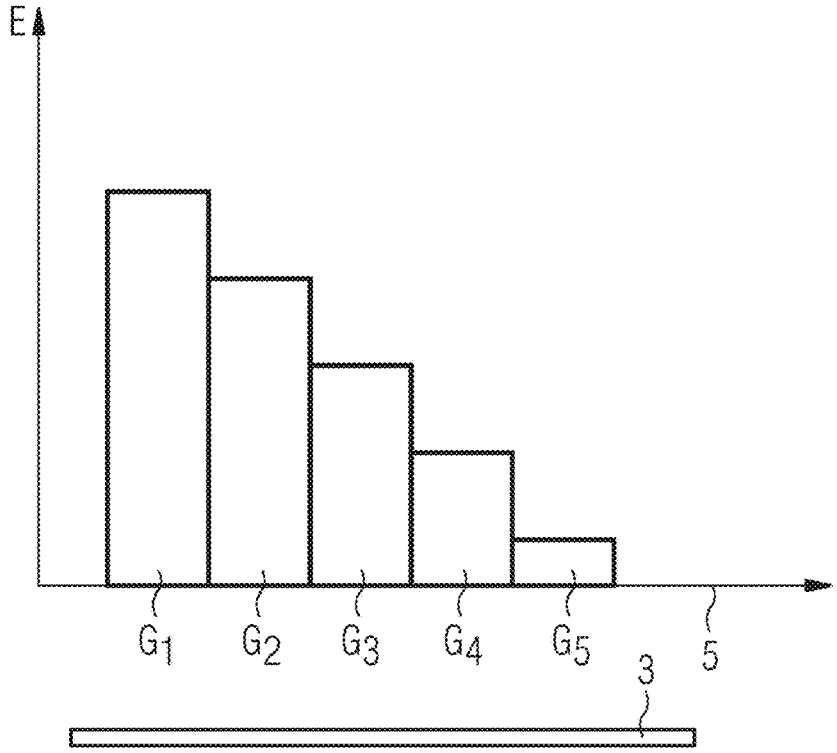
FIG. 4 shows a third example of an emission distribution of the electrons exiting from the electron-emission device according to FIG. 1.

With the solution according to an embodiment of the invention, the emission distributions represented in FIG. 2 to FIG. 4 for the electrons exiting from the emission surface 3 can be achieved for example. The grid segments $G_1$ to $G_N$ have been plotted on the abscissa and the electron emissions E on the ordinate for the representations in a Cartesian coordinates system in each case.

In the emission distribution shown in FIG. 2 the grid voltages $U_{G1}$ to $U_{GN}$ are selected at the grid segments $G_1$ to $G_N$ such that two grid voltages $U_{G1}$ and $U_{GN}$ of identical strength are applied to the grid segments $G_1$ and $G_N$, as a result of which the electron emissions E are of identical strength in each case. The grid segments $G_2$ to $G_{N-1}$ are however blocked by application of higher grid voltages $U_{G2}$ to $U_{GN-1}$, so that no electrons exit at the grid segments $G_2$ to $G_{N-1}$.

In contrast, the grid voltages $U_{G1}$ to $U_{GN}$ at the grid segments $G_1$ to $G_N$ are different for the emission distribution represented in FIG. 3. The electron emissions E are freely selectable by application of a desired grid voltage $U_{GN}$, as a result of which the MTF (Modulation Transfer Function) can be correspondingly influenced. The MTF of the distribution of the X-ray emission occurring at an anode thus contains high-frequency elements, as a result of which the limit resolution of the overall system can be positively influenced (coded spot). In the case shown the grid segments $G_2$ and $G_4$ are completely blocked, in contrast to which an at least partial electron emission E is possible by the grid segments $G_1$, $G_3$ and $G_5$ to $G_N$.

The emission distribution according to FIG. 4 is an asymmetric emission distribution of the electrons penetrating through the barrier grid 5. The grid segments $G_1$ to $G_5$ are differently permeable for the emitted electrons thanks to the grid voltages $U_{G1}$ to $U_{GN}$ applied in each case. The grid segment $G_1$ has the smallest grid voltage $U_{G1}$ and thus the highest electron emission E. Conversely, the highest grid voltage $U_{G5}$ is applied to the grid segment $G_5$, as a result of which a correspondingly small electron emission E occurs. The electrons emitted by the electron emitter 2 generate an asymmetric focal point, which enables a higher electron beam power, when they hit a rotary anode not represented in FIG. 4.

Figure 5:
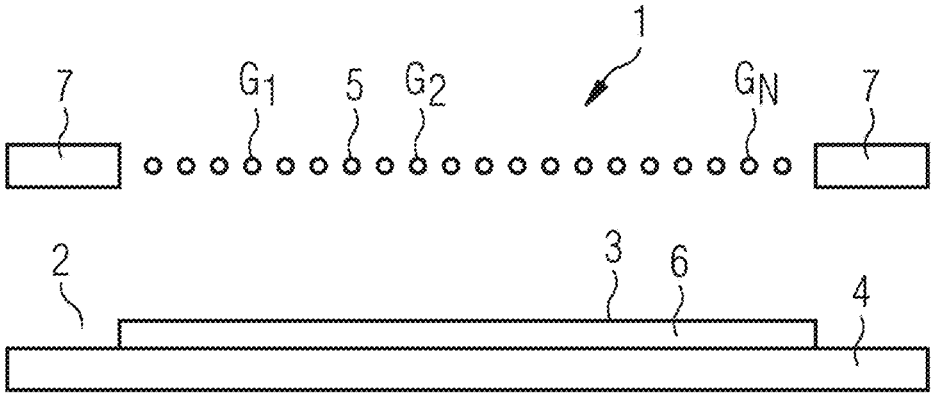
FIG. 5 shows a longitudinal section through an embodiment of an electron-emission device.

An embodiment for an electron-emission device 1 is shown in a longitudinal section in FIG. 5 and in a top view in FIG. 6.

An emitter material 6 is applied to a substrate 4 and emits electrons in an emission surface 3 (electron emission E).

The substrate 4 is for example a base body made of a technical ceramic. The emitter material 6 is for example carbon nanotubes (CNT) or a dispenser cathode material such as barium oxide (BaO) or lanthanum hexaboride ($LaB_6$).

The barrier grid 5, which comprises the grid segments $G_1$ to $G_N$, is arranged on a ceramic carrier 7 spaced apart from the substrate 4 (base body).

As is apparent from FIG. 6, the grid segments $G_1$ to $G_N$ are each controlled individually with the corresponding grid voltages $U_{G1}$ to $U_{GN}$. For reasons of clarity the grid segments $G_3$ to $G_{N-1}$ are not shown. The barrier grid 5 can for example be manufactured from tungsten sheet, from which the grid segments $G_1$ to $G_N$, which form the grid structure, are cut out using laser cutting.

Figure 7:
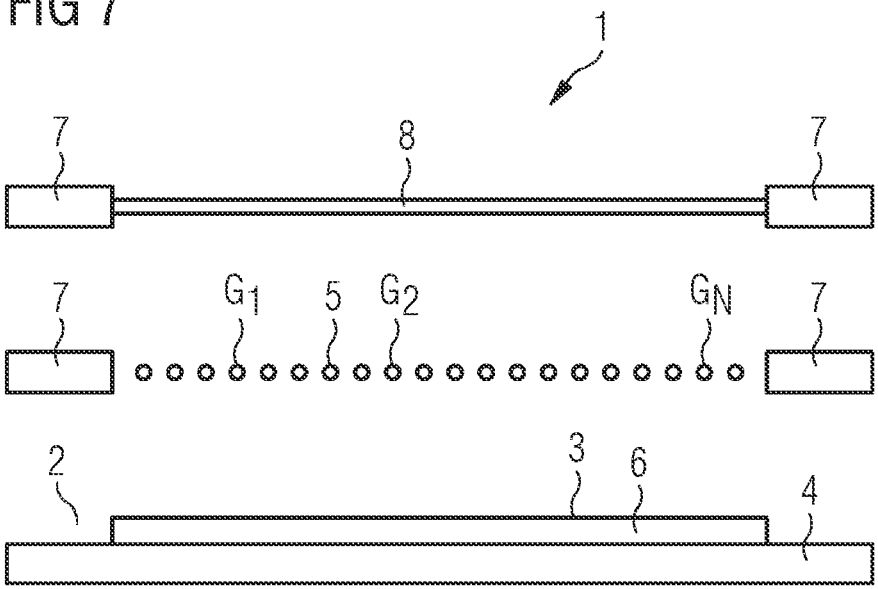
FIG. 7 shows a longitudinal section through an embodiment of an electron-emission device.

For specific requirements it may be advantageous to arrange a second barrier grid 8 (FIG. 7) parallel and orthogonal to and spaced apart from the barrier grid 5. The second barrier grid 8 likewise has a predefinable number of individually controllable grid segments. Thus the emission distribution E of the electrons can be arbitrarily controlled in two spatial directions. The segmented barrier grid from the example embodiment according to FIGS. 5 and 6 is also suitable for optimizing the electron-emission device known from U.S. Pat. No. 8,374,315 B2.

As is apparent from the description of the example embodiments shown in FIG. 1 to FIG. 6, thanks to the solution according to the invention an improvement in the image quality can easily be achieved, along with a simultaneously reduced anode loading by adjusting the focal point geometry (shape and size) to the specific application.

Although the invention has been illustrated and described in detail based on preferred example embodiments, the invention is not restricted by the example embodiments described and other embodiments can readily be derived therefrom by the person skilled in the art without departing from the protective scope of the invention.

The invention claimed is:

1. An X-ray tube, comprising:

an anode; and an electron emission device, the electron emission device including at least one electron emitter including at least one emission surface and at least one barrier grid, the at least one barrier grid being spaced apart from the at least one emission surface of the electron emitter and including a definable number of individually controllable grid segments, wherein the electron emitter is embodied as a field effect emitter configured to emit electrons when an electrical field strength is applied, and wherein a different grid voltage is applicable to each of the individually controllable grid segments, and wherein an amount of applied grid voltage is selectable in a range from a lower limit value to an upper limit value, wherein the at least one barrier grid includes at least a first barrier grid and a second barrier grid, the second barrier grid being arranged spaced apart from the first barrier grid, wherein planes of the first barrier grid and the second barrier grid run parallel to one another, and wherein the first barrier grid and the second barrier grid each include a definable number of individually controllable grid segments, the individually controllable grid segments of the first barrier grid being configured to run orthogonally to the individually controllable grid segments of the second barrier grid.

2. The X-ray tube of claim 1, further comprising a focus head including the electron-emission device.

3. An X-ray emitter including an emitter housing, in which the X-ray tube of claim 1 is arranged.

4. An X-ray emitter including an emitter housing, in which the X-ray tube of claim 2 is arranged.

* * * * *